US005252145A

United States Patent [19]

Tahara et al.

[11] Patent Number: 5,252,145

[45] Date of Patent: Oct. 12, 1993

[54] METHOD OF NITRIDING NICKEL ALLOY

[75] Inventors: Masaaki Tahara; Haruo Senbokuya; Kenzo Kitano; Tadashi Hayashida, all of Osaka; Teruo Minato, Wakayama, all of Japan

[73] Assignee: Daidousanso Co., Ltd., Osaka, Japan

[21] Appl. No.: 845,080

[22] Filed: Mar. 3, 1992

Related U.S. Application Data

[63] Continuation-in-part of Ser. No. 727,614, Jul. 10, 1991, which is a continuation-in-part of Ser. No. 688,217, Apr. 22, 1991, abandoned, which is a continuation-in-part of Ser. No. 479,013, Feb. 12, 1990, Pat. No. 5,013,371.

[30] Foreign Application Priority Data

Jan. 14, 1992 [JP] Japan ..... 4-24763

[51] Int. Cl.[5] ..... C21D 1/00

[52] U.S. Cl. ..... 148/206; 148/231; 148/234; 148/237

[58] Field of Search ..... 148/206, 234, 237, 231

[56] References Cited

U.S. PATENT DOCUMENTS

| | | | |
|---|---|---|---|
| 1,999,757 | 4/1935 | Harsch | 148/206 |
| 3,129,124 | 4/1964 | Barney | 148/6.35 |
| 4,004,891 | 1/1977 | Lin et al. | 148/207 |
| 4,043,839 | 8/1977 | Hartline et al. | 148/207 |
| 4,464,207 | 8/1984 | Kindlimann | 148/207 |
| 5,013,371 | 5/1991 | Tahara et al. | 148/231 |

FOREIGN PATENT DOCUMENTS

| | | |
|---|---|---|
| 0352061 | 1/1990 | European Pat. Off. . |
| 0408168 | 1/1991 | European Pat. Off. . |

OTHER PUBLICATIONS

Frisk, K. Z. Metallkde, 82 (Feb. 1991) 108.

Patent Abstract of Japan, vol. 8, No. 98, (C-221) (1535) 9 May 1984 of JP-A-59 13 065 (Fujitsu) 23 Jan. 1984.

Frisk, K. Z. Metallkde, 82 (Jan. 1991) 59.

*Primary Examiner*—Upendra Roy

*Attorney, Agent, or Firm*—Armstrong, Westerman, Hattori, McLeland & Naughton

[57] ABSTRACT

A method of nitriding nickel alloy comprising steps of holding nickel alloy in an atmosphere of fluorine- or fluoride-containing gas in a heated condition and holding the fluorinated nickel alloy in a nitriding atmosphere in a heated condition to provide the nickel alloy with improved surface hardness by forming a deep uniform nitrided layer on the surface of the nickel alloy.

5 Claims, 3 Drawing Sheets

METHOD OF NITRIDING NICKEL ALLOY

This application is a continuation-in-part of application Ser. No. 727,614 filed Jul. 10, 1991, which in turn was a continuation-in-part of application Ser. No. 688,217 filed Apr. 22, 1991, now abandoned, which in turn was a continuation-in-part of Ser. No. 479,013 filed Feb. 12, 1990, now U.S. Pat. No. 5,013,371.

FIELD OF THE INVENTION

This invention relates to a method of nitriding a nickel alloy for the improvement of surface hardness and other properties by forming a nitrided layer on a nickel alloy surface.

BACKGROUND OF THE INVENTION

Alloys containing a high-nickel such content as inconel(Ni-Cr), hastelloy(Ni-Cr-Mo), and incolloy have been becoming widely employed because of its superior heat resistance and corrosion resistance. Recently there is an increasing demand for improving wear resistance and other properties of a alloy containing nickel and expanding its applicable fields. However, as to the above-mentioned nickel alloys such as inconel, the method for the improvement of surface hardness has not been established yet. A method of push-out hardening for the improvement of base material intensity and a use of superplastic articles employing powder material are merely studied. However, since the method of push-out hardening increases stiffness of whole alloy, workability of the alloy is damaged. Also superplastic articles employing powder material have difficulty in putting them in practical use due to extremely high cost.

By the way, the mainstreams of the methods of surface hardening for general metallic materials are as follows, (1) a plating method, (2) a coating method such as PVD, and (3) a diffusion method such as nitriding and boriding. However, as to nickel alloy, only some of the coating methods, such as full hard chrome plating and alumina coating, are partly put in practical use as mentioned above. Those methods have difficulty in quality control which is peculiar to the coating method, and limit the application range due to the thinness of the coating. Moreover, high cost for treatment is another problem. As the diffusion method of surface hardening, plasma ion nitriding using glow discharge has been also tried partly as to inconel alloy and hastelloy alloy. However, the treatment of such plasma ion nitriding scarcely forms a hardened nitrided layer on the above-mentioned nickel alloy. Even if formed, that would be a partly formed ultra thin layer with only several micron depth. Therefore, in the present situation, nitriding the above-mentioned nickel alloy is almost given up and far from turning it to practical use.

Accordingly it is an object of the invention to provide a method of nitriding nickel alloy for the improvement of a the surface hardness of the nickel alloy by which a uniformly nitrided deep layer can be formed on the nickel alloy surface.

SUMMARY OF THE INVENTION

In accordance with the invention, the above object can be accomplished by providing a method of nitriding a nickel alloy which comprises the steps of holding the nickel alloy in a fluorine- or fluoride-containing gas atmosphere with heating and holding the fluorinated nickel alloy in a nitriding atmosphere with heating to form the surface layer of the nickel alloy into a nitrided layer.

DETAILED DESCRIPTION OF THE INVENTION

The subject of the invention is a nickel alloy and it is nitrided in a nitriding atmosphere after being fluorided in a fluorine- or fluoride-containing gas atmosphere.

Nickel alloys containing more than 25 weight % (it will be abbreviated to "%" hereafter) nickel, for example, Ni-Cr, Ni-Cr-Mo, and Ni-Cr-Fe are mainly used as the above-mentioned nickel alloy to be the subject of the invention. To be more concrete, they are alloys containing high-nickel such as inconel, hastelloy, and incolloy. Nickel alloys containing not more than 25% nickel can be also the subject of the invention. Therefore, in the invention, the term "nickel alloy" includes both alloys containing more than 25% nickel and not more than 25% nickel. However, alloy containing more than 25% nickel is more suitable. A method does not specify a shape of nickel alloy nor a level of processing. All the materials, intermediate products, and finished products made of nickel alloy are included to the extent of nickel alloy in this invention.

Fluorine- or fluoride-containing gas for a fluorine- or fluoride-containing gas atmosphere, in which the above-mentioned nickel alloy is reacted, is fluorine compound gas, such as $NF_3$, $BF_3$, $CF_4$, HF, $SF_4$, $C_2F_6$, $WF_6$, $CHF_3$, or $SiF_4$. They are used independently or in combination. Besides, fluorine compound gas with F in its molecule can be used as the above-mentioned fluorine- or fluoride-containing gas. Also $F_2$ gas formed by cracking fluorine compound gas in the heat decomposition device and preliminarily formed $F_2$ gas are employed as the above-mentioned fluorine- or fluoride-containing gas. According to the case, such fluorine compound gas and $F_2$ gas are mixed for the use. The above-mentioned fluorine or fluoride-containing gas such as the fluorine compound gas and $F_2$ gas can be used independently, but generally are diluted by inert gas such as $N_2$ gas for the treatment. The concentration of the fluorine- or fluoride-containing gas itself in such diluted gas should amount to, for example, 10,000 to 100,000 ppm, preferably 20,000 to 70,000 ppm, more preferably 30,000 to 50,000 ppm.

In the invention, the above-mentioned nickel alloy is held in a heated condition in a fluorine- or fluoride-containing gas atmosphere of such concentration, and fluorided. This is the most characteristic part of the invention. In this case, nickel alloy is held with heating at the temperature of, for example, 350° to 500° C. The holding time of the above-mentioned nickel alloy in a fluorine- or fluoride-containing gas atmosphere may appropriately be selected depending on the nickel alloy species, geometry and dimension of the alloy, heating temperature and the like, generally within the range of ten and odd minutes to scores of minutes. The treatment of nickel alloy in such a fluorine- or fluoride-containing gas atmosphere allows "N" atoms to penetrate into nickel alloy, which was impossible in the past.

Though the mechanism of the penetration has not been proven at present yet, it can be understood as follows on the whole. That is, the oxidized layer of NiO formed on the nickel alloy surface inhibits "N" atoms for nitrization from the penetration. Upon holding the nickel alloy with an oxidized layer in a fluorine- or fluoride-containing gas atmosphere with heating as mentioned above, the oxidized layer of NiO is converted to a fluorinated layer of $NiF_2$. "N" atoms for nitrization penetrate more readily into the fluorinated layer of $NiF_2$ than into the oxidized layer of NiO, that is, the nickel alloy surface is formed to the suitable condition for the penetration of "N" atoms by the above-mentioned fluorination. Thus, it is considered that "N" atoms in the nitriding gas penetrate uniformly into the nickel alloy to the certain depth when nickel alloy is held in a nitriding atmosphere with the suitable surface condition to absorb "N" atoms as follows, resulting the formation of a deep uniform nitriding layer.

Then, as mentioned above, the nickel alloy with suitable surface condition to absorb "N" atoms by fluorination is held with heating in a nitriding atmosphere so as to nitride. In this case, the nitriding gas composing the nitriding atmosphere is a simple gas composed of $NH_3$ only, or a mixed gas composed of $NH_3$ and a carbon source gas, for example, RX gas. Mixture of both gasses can be also used. Generally, the above-mentioned simple gas mixed with an inert gas such as $N_2$ is used. According to the situation, $H_2$ gas is added to those gasses.

In such a nitriding atmosphere, the above-mentioned fluorinated nickel alloy is held with heating. The heating condition is generally set at a temperature of 500° to 700° C., and treatment time is set within the range of 3 to 6 hours. By this nitriding treatment, a close nitriding layer (consisting of entirely single layer) is formed deeply and uniformly on the surface of the above-mentioned nickel alloy, whereby the surface hardness of nickel alloy reaches Hv=800 to 1100 in comparison with that of base material thereof which has Hv=280 to 380. Thickness of the hardened layer basically depends on the nitriding temperature and time. However a temperature below 500° C. causes difficulty in forming a nitriding layer, and at a temperature over 650° C., the fluorinated layer is damaged and Ni is easily oxidized thereby resulting in a tendency of unevenly nitrided layer formation.

On the other hand, a sufficient fluorinated layer ordinarily can not be formed at the fluoriding temperature below 400° C. Also the temperature over 600° C. is not appropriate for an industrial process because the furnace materials in a muffle furnace are worn out due to the extreme fluoriding reaction. From a viewpoint of forming a nitriding layer, it is also preferable that the difference between fluoriding temperature and nitriding temperature be as small as possible. For example, a proper nitriding layer is not formed by nitriding after fluoriding and cooling once.

The above-mentioned fluoriding and nitriding steps are, for example, conducted in a metallic muffle furnace as shown in FIG. 1, that is, the fluoriding treatment is carried out first, and then nitriding treatment is put in practice at the inside of the muffle furnace. In FIG. 1, the reference numeral 1 is a muffle furnace, 2 an outer shell of the muffle furnace, 3 a heater, 4 an inner vessel, 5 a gas inlet pipe, 6 an exhaust pipe, 7 a motor, 8 a fan, 11 a metallic container, 13 a vacuum pump, 14 a noxious substance eliminator, 15 and 16 cylinders, 17 flow meters, and 18 a valve. Nickel alloy articles 10 are put in the furnace 1 and fluorided by introducing fluorine- or fluoride-containing gas atmosphere such as $NF_3$ with heating. The gas is lead into the exhaust pipe 6 by the action of vacuum pump 13 and detoxified in the noxious substance eliminator 14 before being exhausted. And then, the cylinder 15 is connected with a duct to carry out nitriding by introducing a nitriding gas into the furnace 1. After nitriding, the gas is drawn out via the exhaust pipe 6 and the noxious substance eliminator 14. Through the series of these operations, fluoriding and nitriding treatments are put in practice. Also a device as shown in FIG. 2 can be employed instead of one in FIG. 1. This device comprises a fluoriding chamber on the left side and a nitriding chamber on the right side. In the figure, the reference numeral 2' are metallic containers, 3' a heater, 5' an exhaust gas pipe, 6' and 7' open-close covers, 11' a base, 21 a furnace body with adiabatic walls, and 22 a barrier movable up and down. The barrier 22 divides the inner space of the furnace body 21 into two chambers, 23 and 24. The chamber 23 is designed for a fluoriding chamber and 24 is for a nitriding chamber. The reference numeral 25 is a rack comprising two rails on which a metallic container 2' having nickel alloy articles therein can slide back and forth between chambers 23 and 24. The reference numeral 10' is legs of the rack 25. The reference numeral 26 is a gas introducing pipe which leads a fluorine- or fluoride-containing gas into the fluoriding chambers 23, 27 a temperature sensor, and 28 a nitriding gas introducing pipe. High-nickel based heat resistance alloy is desirable as material for the above-mentioned metallic muffle furnace 1 instead of stainless steel material.

This device is a continuous treatment system in which the inner temperature of a fluoriding chamber 23 is raised by the heating on nitriding in the nitriding chamber 24, nickel alloy articles are introduced into the fluoriding chamber 23 under that condition to be fluorided. After exhausting the gas in fluoriding chamber 23, the nickel alloy articles together with the metallic container were transferred to the nitriding chamber 24 by opening and shutting the barrier 22. And then, nitriding is carried out under that condition thereby conducting fluoriding and nitriding continuously.

The adoption of $NF_3$ as fluorine- or fluoride-containing gas is suitable in particular for the above-mentioned fluoriding. That is, $NF_3$ is a handy gaseous substance that has no reactivity at ordinary temperature allowing operations and detoxification of exhaust gas to be easy.

The following modes for carrying out the invention illustrate the invention.

EXAMPLE 1

Figure 1:
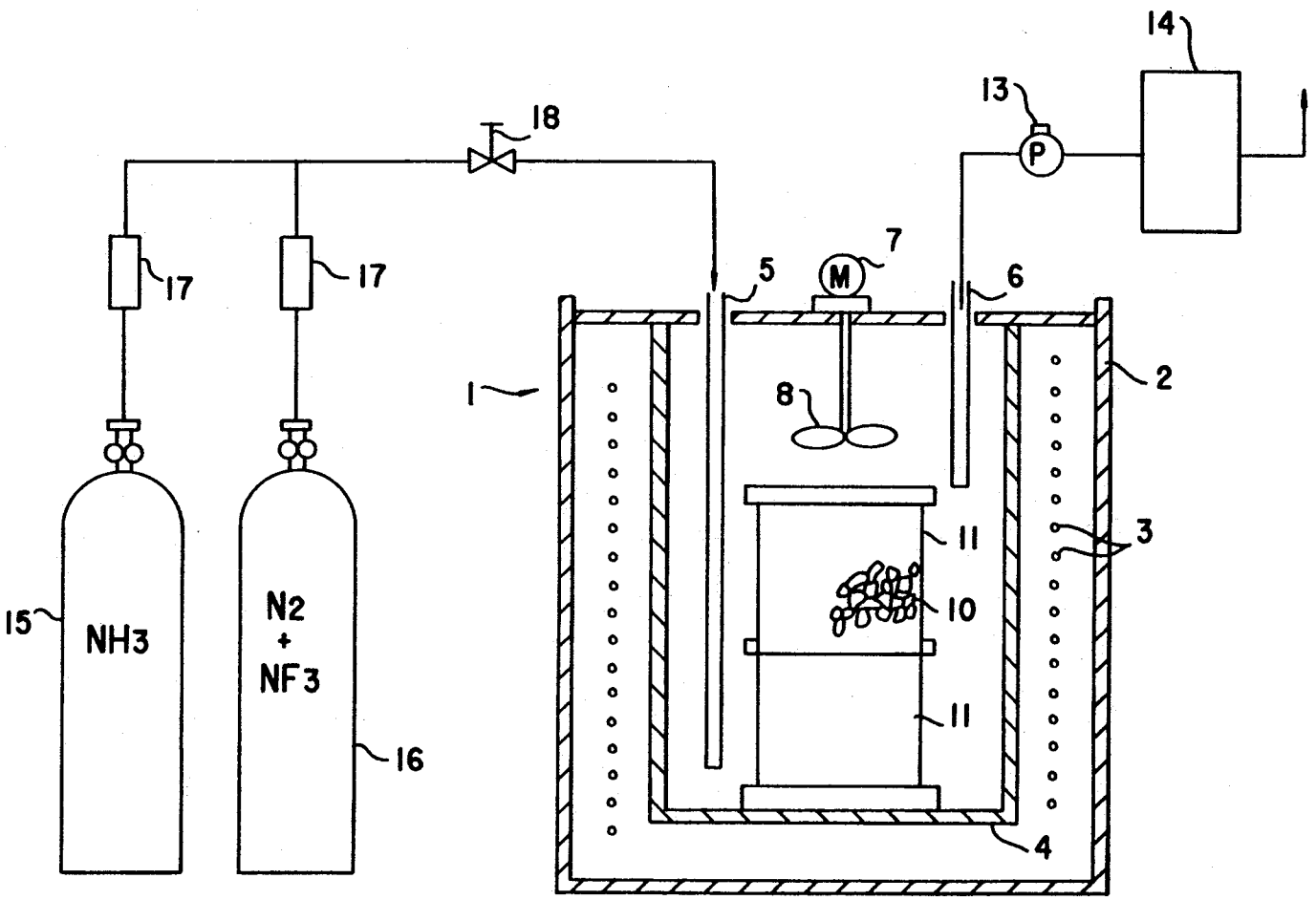
FIG. 1 schematically shows a construction of the treatment furnace for carrying out nitriding according to the invention, FIG. 2 schematically shows a construction of another embodiment of a furnace.
Figure 2:
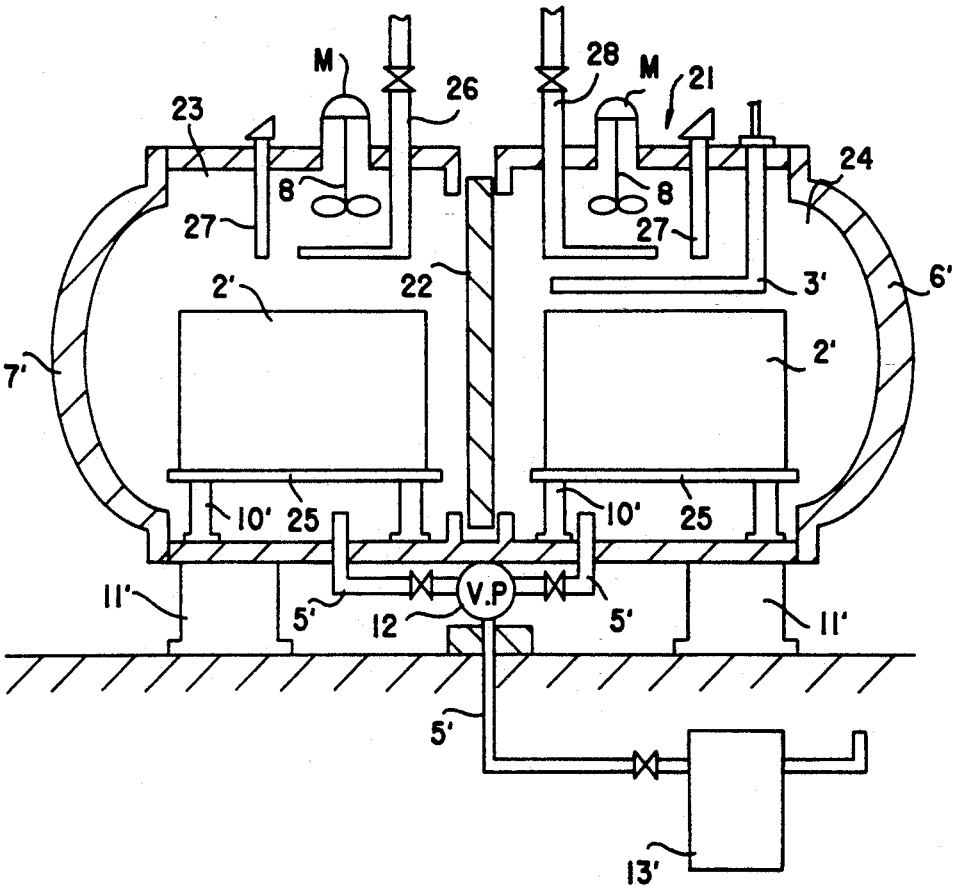
Figure 3:
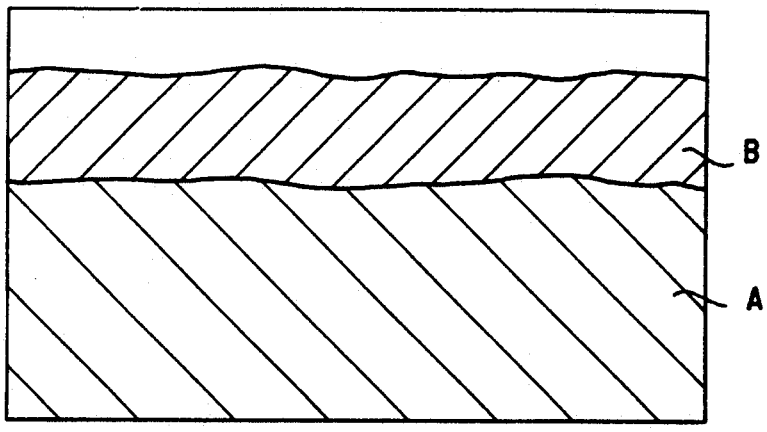
FIG. 3 is an enlarged sectional view of a nitrided nickel alloy plate (inconel 600)
Figure 4:
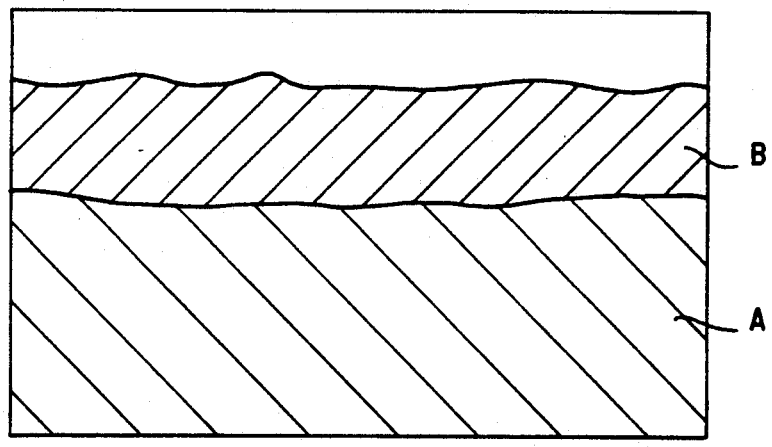
FIG. 4 is an enlarged sectional view of a nitrided nickel alloy plate (inconel 751)
Figure 5:
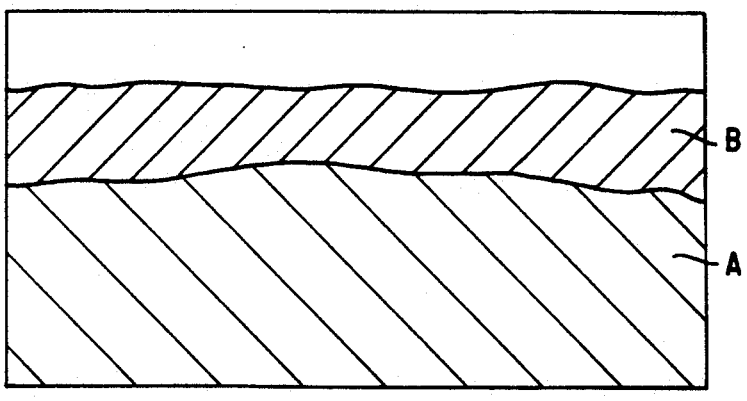
FIG. 5 is an enlarged sectional view of a nitrided nickel alloy plate (hastelloy C).

Three kinds of nickel alloy plates made of inconel 600 (Ni:76, Cr:16, Fe:8), inconel 751 (Ni:73, Cr:16, Ti:2.5), and hastelloy C (Ni:56, Cr:16, Mo:7) were charged into a treatment furnace as shown in FIG. 1. After vacuum purging the inside of the furnace, it was heated to 550° C. Then, in that state, fluorine- or fluoride-containing gas (NF, 10 Vol % + $N_2$ 90 Vol%) was charged into the furnace to form an atmospheric pressure in it and the condition was maintained for 30 minutes. Then after exhausting the above-mentioned fluorine- or fluoride-containing gas out of the furnace, nitriding gas ($NH_3$ 50 vol %+$N_2$ 25 vol %+$H_2$ 25 Vol %) was introduced into the furnace and the inside of the furnace was heated to 570° C. Nitriding treatment was carried out in this condition for 3 hours. Through this nitriding process, surface hardening layers B of a nitrided layer were formed on the surface of three kinds of nickel alloy plates made of inconel 600, inconel 751, and hastelloy C respectively, and their thickness each was 15 μm, 12 μm, and 10 μm as shown in FIG. 3, FIG. 4, and FIG. 5. In these drawings, "A" shows base material of nickel alloy. Also the surface hardness of those surface hardening layers B was Hv=800~1,000 in each case.

EXAMPLE 2

Three kinds of nickel alloy plates made of inconel 600, inconel 751, and hastelloy C were charged into a treatment furnace as shown in FIG. 1. After vacuum purging the inside of the furnace, it was heated to 350° C. Then, in that state, fluorine- or fluoride-containing gas ($NF_3$ 10 Vol %+$N_2$ 90 vol %) was charged into the furnace to form an atmospheric pressure in it and the condition was maintained for 30 minutes. Then after exhausting the above-mentioned fluorine- or fluoride-containing gas out of the furnace, nitriding gas ($NH_3$ 50 Vol %+RX 50 vol %) was introduced into the furnace and the inside of the furnace was heated to 530° C. Nitriding treatment was carried out in this condition for 5 hours. Through this nitriding process, surface hardening layers of a nitrided layer were formed on the surface of three kinds of nickel alloy plates made of inconel 600, inconel 751, and hastelloy C respectively, and their thickness each was 12 μm, 12 μm, and 10 μm . Also the surface hardness of those surface hardening layers was Hv=650~1,050 in each case.

EXAMPLE 3

With three kinds of nickel alloy plates made of inconel 600, inconel 751, and hastelloy C respectively, a fluoriding treatment was carried out in the same way as Example 1. Then a nitriding treatment was carried out at the temperature of 620° C. for 3 hours to them while a mixed gas composed of $NH_3$ 50 Vol %+$N_2$ 50 Vol % was introduced into the furnaces as a nitriding gas. After nitriding, fluoriding was carried out at a temperature of 620° C. for 3 hours employing similar fluorine- or fluoride-containing gas mentioned to that of Example 1 and further nitriding treatment was carried out again at a temperature of 620° C. for 3 hours employing the above-mentioned nitriding gas. In this way fluoriding and nitriding were put in practice two times each to three kinds of nickel alloy and the thickness of the hard layers made of a nitrided layer formed on those surfaces was measured. As a result, the thickness of each hard layer of inconel 600, inconel 751, and hastelloy C was 25 μm, 20 μm, and 18 μm. It was found their surface hardness was the same as that of Example 1.

EXAMPLE 4

A mixed gas composed of $F_2$ 10 Vol %+$N_2$ 90 Vol % was employed as fluorine- or fluoride-containing gas. Except for this difference, all the same fluoriding and nitriding treatments were carried out to three kinds of nickel alloy plates as in Example 1. As a result, the same nitrided hard layers as in Example 1 were formed on the surface of three kinds of plates after the treatments, and the surface hardness was the same as that of Example 1.

EFFECT OF THE INVENTION

As mentioned hereinbefore, the method of nitriding nickel alloy according to the invention comprises holding a nickel alloy with heating in a fluorine- or fluoride-containing gas atmosphere to thereby eliminate organic and inorganic contaminants stuck to the nickel alloy and at the same time causing an oxidised layer on the nickel alloy surface to be converted to a fluorinated layer, and then subjecting the alloy to the nitriding treatment. Since the oxidised layer on the nickel alloy surface is converted to a fluorinated layer in that manner, an existence of the fluorinated layer protects the nickel alloy surface. Therefore, even after a lapse of certain time from fluoriding to nitriding, the above-mentioned fluorinated layer protects the nickel alloy surface. As a result, no oxidized layer can be formed again on the nickel alloy surface. Since such a fluorinated layer can transmit "N" atoms, "N" atoms can penetrate uniformly into the nickel alloy surface layer in a certain depth at the time of nitriding. The resulting uniform penetration leads to the formation of a close uniform nitriding layer in the depth only in the nickel alloy surfacial layer and the improvement of surface hardness drastically without raising the base material stiffness of the nickel alloy.

What are claimed are:

1. A method of nitriding nickel alloy comprising steps of holding nickel alloy in a fluorine- or fluoride-containing gas atmosphere with heating and holding the fluorinated nickel alloy in a nitriding atmosphere with heating to form a nitrided layer in the surface layer of the nickel alloy.

2. A method of nitriding nickel alloy as mentioned in claim 1 wherein a gas for a fluorine- or fluoride-containing gas atmosphere is composed of at least one of below-mentioned (a), (b), or (c) and an inert gas to dilute them, (a) a fluorine compound-gas containing at least one component selected from the group consisting of $NF_3$, $BF_3$, $CF_4$, HF, $SF_6$, $C_2F_6$, $WF_6$, $CHF_3$, and $SiF_4$, (b) a $F_2$ gas formed by cracking the above-mentioned fluorine compound gas ( a ), (c) preliminarily formed $F_2$ gas.

3. A method of nitriding nickel alloy as mentioned in claim 1 wherein the holding nickel alloy in a fluorine- or fluoride-containing gas atmosphere in a heated condition is conducted at temperatures of 350° C. to 600° C.

4. A method of nitriding nickel alloy as mentioned in claim 1 wherein a gas for nitriding atmosphere is a simple gas composed of $NH_3$ only, a mixed gas composed of $NH_3$ and RX gas, an inert gas-mixed gas formed by mixing an inert gas with one of the above-mentioned simple $NH_3$ gas or the mixed gas of $NH_3$ and RX gas, or a mixed gas formed by mixing $H_2$ gas with the inert gas-mixed gas.

5. A method of nitriding nickel alloy as mentioned in claim 1 wherein the holding nickel alloy in a nitriding atmosphere in a heated condition is conducted at temperatures of 500° C. to 700° C.

* * * * *